US011519045B2

(12) United States Patent
Jung

(10) Patent No.: US 11,519,045 B2
(45) **Date of Patent: *Dec. 6, 2022**

(54) HIGH-STRENGTH STEEL HAVING EXCELLENT LOW-YIELD-RATIO CHARACTERISTICS, AND MANUFACTURING METHOD THEREFOR

(71) Applicant: POSCO, Pohang-si (KR)

(72) Inventor: Hwan-Gyo Jung, Pohang-si (KR)

(73) Assignee: POSCO, Pohang-si (KR)

( * ) Notice: Subject to any disclaimer, the term of this patent is extended or adjusted under 35 U.S.C. 154(b) by 81 days.

This patent is subject to a terminal disclaimer.

(21) Appl. No.: 16/957,333

(22) PCT Filed: Dec. 24, 2018

(86) PCT No.: PCT/KR2018/016593

§ 371 (c)(1),
(2) Date: Jun. 23, 2020

(87) PCT Pub. No.: WO2019/125091

PCT Pub. Date: Jun. 27, 2019

(65) Prior Publication Data

US 2020/0347469 A1 Nov. 5, 2020

(30) Foreign Application Priority Data

Dec. 24, 2017 (KR) ..... 10-2017-0178931

(51) Int. Cl.

| | |
|---|---|
| ***C22C 38/04*** | (2006.01) |
| ***C21D 8/00*** | (2006.01) |
| ***C21D 6/00*** | (2006.01) |
| ***C22C 38/00*** | (2006.01) |
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/48*** | (2006.01) |
| ***C22C 38/50*** | (2006.01) |
| ***C22C 38/58*** | (2006.01) |

(52) U.S. Cl.

CPC ..... *C21D 8/005* (2013.01); *C21D 6/004* (2013.01); *C21D 6/005* (2013.01); *C21D 6/008* (2013.01); *C22C 38/001* (2013.01); *C22C 38/002* (2013.01); *C22C 38/02* (2013.01); *C22C 38/06* (2013.01); *C22C 38/42* (2013.01); *C22C 38/44* (2013.01); *C22C 38/48* (2013.01); *C22C 38/50* (2013.01); *C22C 38/58* (2013.01); *C21D 2211/002* (2013.01); *C21D 2211/005* (2013.01); *C21D 2211/008* (2013.01); *C21D 2211/009* (2013.01)

(58) Field of Classification Search

CPC ..... C22C 38/06

See application file for complete search history.

(56) References Cited

U.S. PATENT DOCUMENTS

| | | | | |
|---|---|---|---|---|
| 2014/0299235 | A1 | 10/2014 | Anelli et al. | |
| 2015/0059912 | A1 | 3/2015 | Shimamura et al. | |
| 2015/0203949 | A1 | 7/2015 | Yokoi et al. | |
| 2019/0316218 | A1* | 10/2019 | Jung | C22C 38/06 |
| 2020/0087765 | A1* | 3/2020 | Um | C22C 38/00 |
| 2020/0239977 | A1* | 7/2020 | Koh | C22C 38/002 |

FOREIGN PATENT DOCUMENTS

| | | | |
|---|---|---|---|
| CN | 101649420 | A | 2/2010 |
| CN | 102168229 | A | 8/2011 |
| CN | 104789866 | A | 7/2015 |
| CN | 106480374 | A | 3/2017 |
| EP | 2589673 | A1 | 5/2013 |
| JP | 2004-315925 | A | 11/2004 |
| JP | 2006-336065 | A | 12/2006 |
| JP | 2011-074443 | A | 4/2011 |
| JP | 2011-195883 | A | 10/2011 |
| JP | 2013-007080 | A | 1/2013 |
| JP | 2013-023714 | A | 2/2013 |
| JP | 2013-227670 | A | 11/2013 |
| KR | 10-1997-0043168 | A | 7/1997 |
| KR | 10-0723155 | B1 | 5/2007 |
| KR | 10-2013-0073472 | A | 7/2013 |
| KR | 10-2014-0055460 | A | 5/2014 |
| KR | 10-2015-0038727 | A | 4/2015 |

OTHER PUBLICATIONS

English machine translation of KR 10-2013-0073472 A of Yoo (Year: 2013).*

Office Action issued in corresponding Chinese Patent Application No. 201880083709.9, dated Mar. 24, 2021.

Extended European Search Report issued in corresponding European Patent Application No. 18892141.5, dated Feb. 1, 2021.

International Search Report dated Apr. 4, 2019 issued in International Patent Application No. PCT/KR2018/016593 (along with English translation).

* cited by examiner

*Primary Examiner* — Jophy S. Koshy

(74) *Attorney, Agent, or Firm* — Morgan, Lewis & Bockius LLP

(57) ABSTRACT

A high-strength steel having excellent low-yield-ratio characteristics, according to one embodiment of the present invention, comprises, by wt %, 0.06-0.12% of C, 0.2-0.5% of Si, 1.5-2.0% of Mn, 0.003-0.05% of Al, 0.01% or less of N, 0.02% or less of P, 0.003% or less of S, 0.05-0.5% of Cr, 0.05-0.5% of Mo, 0.01-0.05% of Nb, 0.0005-0.005% of Ca and the balance of Fe and other inevitable impurities, and comprises polygonal ferrite as a microstructure, wherein the area fraction of the polygonal ferrite is 10-30% and the average hardness of the polygonal ferrite can be 180 Hv or less.

5 Claims, No Drawings

HIGH-STRENGTH STEEL HAVING EXCELLENT LOW-YIELD-RATIO CHARACTERISTICS, AND MANUFACTURING METHOD THEREFOR

CROSS-REFERENCE OF RELATED APPLICATIONS

This application is the U.S. National Phase under 35 U.S.C. § 371 of International Patent Application No. PCT/KR2018/016593, filed on Dec. 24, 2018, which in turn claims the benefit of Korean Application No. 10-2017-0178931, filed on Dec. 24, 2017, the entire disclosures of which applications are incorporated by reference herein.

TECHNICAL FIELD

The present disclosure relates to a pipe steel material and a method of manufacturing the same, and particularly, to a high-strength steel material having an excellent low yield ratio characteristic and a method of manufacturing the same.

BACKGROUND ART

A pipe steel material is manufactured into a pipe via pipe making molding by various methods. Upon pipe molding, when plastic deformation is easy, plastic deformability of an entire pipe is uniform, and no cracks or fracture occurs during pipe molding, pipe making ability may be evaluated to be excellent. In addition, when fracture of a pipe does not occur and may be deformed even in a sudden change of transport pressure during use of the pipe, pipe stability may be evaluated to be excellent. A physical property required for improving pipe making ability and stability of a pipe steel material is a lowered yield ratio. This is because, the lower the yield ratio of the steel material is, the larger the difference between a yield stress and a tensile stress is, and thus, a margin stress until the pipe reaches fracture after plastic deformation occurs is increased.

A yield ratio is a physical property depending on a microstructure. Generally, when phases having different hardnesses are mixed, the yield ratio tends to be lowered. That is, it may be confirmed that while a low yield ratio value is obtained in a microstructure composed of ferrite and pearlite bands manufactured by normalizing heat treatment, a high yield ratio value is obtained in a high-strength steel composed of only bainite. When two phases having different hardnesses are present, a yield strength is influenced by strength and fraction of a low-hardness phase, and a tensile strength is influenced by strength and fraction of a high-hardness phase. Therefore, when the strengths and the fractions of a low-hardness phase and a high-hardness phase are optimally controlled, a low yield ratio may be secured.

However, since a pipe steel material, in particular, a line pipe steel material requires strength and toughness at or above a certain level as well as the yield ratio, the microstructure may not be controlled considering only the yield ratio. When a fraction of polygonal ferrite which is a low-hardness phase is raised more than necessary, the yield strength is lowered, and when a fraction of martensite or bainite which is a high-hardness phase is raised, toughness is deteriorated.

Accordingly, it is required of a pipe steel material, in particular, a line pipe steel material to secure strength and toughness at or above a certain level, and also, to have a low yield ratio characteristic to secure pipe making ability and safety.

[Related Art Document] Korean Patent Laid-open Publication No. 1997-0043168 (published on Jul. 26, 1997)

DISCLOSURE

Technical Problem

An aspect of the present disclosure is to provide a high-strength steel material having an excellent low yield ratio characteristic and a method of manufacturing the same.

An object of the present disclosure is not limited to the above description. A person skilled in the art will have no difficulty in understanding of further objects of the present disclosure from the overall descriptions of the present specification.

Technical Solution

According to an aspect of the present disclosure, a high-strength steel material having an excellent low yield ratio characteristic includes, by wt %: 0.06 to 0.12% of C, 0.2 to 0.5% of Si, 1.5 to 2.0% of Mn, 0.003 to 0.05% of Al, 0.01% or less of N, 0.02% of less of P, 0.003% or less of S, 0.05 to 0.5% of Cr, 0.05 to 0.5% of Mo, 0.01 to 0.05% of Nb, and 0.0005 to 0.005% of Ca, with a balance of Fe and other unavoidable impurities, and polygonal ferrite as a microstructure, wherein the polygonal ferrite may have an area fraction of 10 to 30% and an average hardness of 180 Hv or less.

The steel material further includes a residual structure having an average hardness of 200 Hv or more, and the residual structure may include acicular ferrite, bainite, pearlite, and martensite.

A sum of area fractions of the pearlite and martensite may be 10% or less relative to a total area.

The steel material may further include, by wt %, one or two or more of: 0.05 to 0.3% of Ni, 0.05 to 0.3% of Cu, 0.005 to 0.02% of Ti, and 0.0005 to 0.0015% of B.

The steel material may have a Charpy impact energy at −30° C. of 200 J or more.

The steel material may have a yield ratio of 90% or less.

The steel material may have a tensile strength of 500 MPa or more.

According to another aspect of the present disclosure, a method of manufacturing a high-strength steel material having an excellent low yield ratio characteristic includes: reheating a slab including, by wt %: 0.06 to 0.12% of C, 0.2 to 0.5% of Si, 1.5 to 2.0% of Mn, 0.003 to 0.05% of Al, 0.01% or less of N, 0.02% of less of P, 0.003% of less of S, 0.05 to 0.5% of Cr 0.05 to 0.5% of Mo, 0.01 to 0.05% of Nb, and 0.0005 to 0.005% of Ca, with a balance of Fe and other unavoidable impurities in a temperature range of 1100 to 1160° C.; roughly rolling the reheated slab at a termination temperature of 1050° C. or higher; starting finish rolling of the roughly rolled slab in a temperature range of 980° C. or lower and ending the finish rolling in a temperature range of (Ar3+50° C.) to 900° C.; first cooling the finish-rolled steel material down to a temperature range of (Ar3−40° C.) to (Ar3−70° C.) at a first cooling rate; and second cooling the first cooled steel material down to a temperature range of 350 to 400° C. at a second cooling rate.

An effective reduction ratio of the finish rolling may be 65% or more.

The second cooling rate may be higher than the first cooling rate by 10 to 40° C./s.

A start temperature of the first cooling may be (Ar3+10° C.) to (Ar3+30° C.)

The first cooling rate may be 10 to 20° C./s.

The second cooling may be performed directly after the first cooling.

The second cooling rate may be 30 to 50° C./s.

The second cooled steel material may be air-cooled down to room temperature.

The slab may further include, by wt %, one or two or more of: 0.05 to 0.3% of Ni, 0.05 to 0.3% of Cu, 0.005 to 0.02% of Ti, and 0.0005 to 0.0015% of B.

Advantageous Effects

As set forth above, according to an exemplary embodiment in the present disclosure, a steel material which may secure both a tensile strength of 500 MPa or more and a yield ratio of 90% or less and a method of manufacturing the same, and thus, pipe making ability and safety of a pipe steel material may be effectively secured.

BEST MODE FOR INVENTION

The present disclosure relates to a high-strength steel material having an excellent low yield ratio characteristic and a method of manufacturing the same, and hereinafter, preferred exemplary embodiments of the present disclosure will be described. The exemplary embodiments of the present disclosure may be modified in various forms, and the scope of the disclosure should not be interpreted to be limited to the exemplary embodiments set forth below. These exemplary embodiments are provided in order to describe the present disclosure in more detail to those with ordinary skill in the art to which the present disclosure pertains.

Hereinafter, the steel composition of the present disclosure will be described in more detail. Hereinafter, % which representing a content of each element, is by weight, unless otherwise particularly indicated.

The high-strength steel material having an excellent low yield ratio characteristic according to an aspect of the present disclosure may include, by wt %: 0.06~0.12% of C, 0.2 to 0.5% of Si, 1.5 to 2.0% of Mn, 0.003 to 0.05% of Al, 0.01% or less of N, 0.02% or less of P, 0.003% of less of S, 0.05 to 0.5% of Cr, 0.05 to 0.5% of Mo, 0.01 to 0.05% of Nb, and 0.0005 to 0.005% of Ca, with a balance of Fe and other unavoidable impurities.

C: 0.06 to 0.12%

C is an element effective for strengthening steel by solid solution strengthening and precipitation strengthening. In particular, since C is an element having a larger influence on tensile strength than a yield strength, C is an element effectively contributing to a decrease in a yield ratio. Therefore, in the present disclosure, a lower limit of a C content may be limited to 0.06%. However, when C is excessively added, toughness may be deteriorated, and thus, in the present disclosure, an upper limit of a C content may be limited to 0.12%. Therefore, in the present disclosure, the C content may be 0.06 to 0.12%. In addition, when the C content is more than 0.10%, cracks on a slab surface often occur in a steel making and soft casting process, and the preferred C content of the present disclosure may be 0.06 to 0.10%.

Si: 0.2 to 0.5%

Si is an element which is used as a deoxidizer and also contributes to solid solution strengthening to improve steel strength. In addition, Si is an element promoting production of island-shaped martensite (MA) during phase transformation. The island-shaped martensite (MA) is an element contributing to a low yield ratio characteristic. Therefore, in the present disclosure, a lower limit of a Si content may be limited to 0.2%, considering production of the island-shaped martensite (MA). However, when Si is excessively added, peelability of a scale grown in a heating furnace is deteriorated, whereby surface quality after rolling completion may be deteriorated, and thus, in the present disclosure, an upper limit of a Si content may be limited to 0.5%. Therefore, in the present disclosure, the Si content may be 0.2 to 0.5%.

Mn: 1.5 to 2.0%

Mn is a solid solution strengthening element which improves steel strength and increases hardenability of steel to promote production of a low-temperature transformation phase. For lowering a yield ratio, an appropriate fraction of low-temperature transformation phase should be included in a microstructure. Therefore, in the present disclosure, a lower limit of a Mn content may be limited to 1.5%, for producing the low-temperature transformation phase. However, when Mn is excessively added, production of coarse bainite is promoted by center segregation during slab casting, thereby decreasing center toughness and also decreasing weldability of steel, and thus, in the present disclosure, an upper limit of a Mn content may be limited to 2.0%. Therefore, in the present disclosure, the Mn content may be 1.5 to 2.0%.

Al: 0.003 to 0.05%

Al is a representative deoxidizer element, and when the content is less than 0.003%, a sufficient deoxidizing effect may not be expected, and thus, in the present disclosure, a lower limit of an Al content may be limited to 0.003%. In addition, when Al is excessively added, $Al_2O_3$ which is a non-metal oxide is excessively formed to deteriorate toughness of a base material and a weld, and thus, in the present disclosure, an upper limit of an Al content may be limited to 0.05%. Therefore, the Al content of the present disclosure may be 0.003 to 0.05%, and a more preferred Al content may be 0.005 to 0.05%.

N: 0.01% or less

N is an element which is bonded to Al to form a nitride to contribute to strength improvement of steel. However, when N is excessively added, toughness may be deteriorated by N in a solid solution state, and thus, in the present disclosure, an upper limit of a N content may be limited to 0.01%. In addition, since it is industrially and economically difficult to completely remove N from steel, a lower limit of a N content may be limited to 0.001% which is an acceptable range in a manufacturing process. Therefore, the N content of the present disclosure may be 0.01% or less, and a more preferred N content may be 0.001 to 0.01%.

P: 0.02% or less

P is an element inevitably included in steel during steelmaking, which deteriorates weldability and toughness and also is easily segregated in a slab center part and an austenite grain boundary upon solidification, and deteriorates toughness of steel. Therefore, for securing an appropriate level of toughness, it is preferred to limit the content to a certain degree or lower. In particular, when a P content is more than 0.02%, brittle fracture is promoted in a thickness center of the steel material so that it is difficult to secure low-temperature toughness, and thus, in the present disclosure, the P content may be limited to 0.02% or less.

S: 0.003% or less

S is an impurity element which is inevitably included in steel during steelmaking, and forms non-metallic inclusions such as MnS in a thickness center of the steel material to inhibit the low-temperature toughness. When a S content is more than 0.003%, a large amount of non-metallic inclusions is formed in the thickness center of the steel material to act as a starting point of brittle fracture and provide a path of crack propagation. Therefore, in the present disclosure, the S content may be limited to 0.003% or less for securing toughness.

Cr: 0.05 to 0.5%

Cr is an element which secures sufficient hardenability upon cooling and contributes to the effect of a low-temperature transformation phase and a second phase such as cementite, and thus, effectively contributes to a decrease in a yield ratio. In the present disclosure, a lower limit of a Cr content may be limited to 0.05%, for obtaining the effect. However, when Cr is excessively added, toughness of a weld may be deteriorated, and thus, in the present disclosure, an upper limit of a Cr content may be limited to 0.5%. Therefore, in the present disclosure, the Cr content may be 0.05 to 0.5%, and the more preferred Cr content may be 0.05 to 0.45%.

Mo: 0.05 to 0.5%

Mo is an element which has a very high hardenability like Cr, and promotes production of a low-temperature transformation phase even with addition of a small amount to effectively contribute to lowering a yield ratio. By addition of Mo, a fraction of bainite or martensite may be increased, leading to a decrease in a yield ratio. In the present disclosure, a lower limit of a Mo content may be limited to 0.05%, for obtaining the effect. However, since Mo is an element having a high alloy cost, in the present disclosure, an upper limit of a Mo content may be limited to 0.5% in terms of economic feasibility. Therefore, the Mo content may be 0.05 to 0.5%, and the more preferred Mo content may be 0.05 to 0.45%.

Nb: 0.01 to 0.05%

Nb is present as a precipitate in the form of a carbide or nitride in a slab, but is solid-solubilized into steel in a reheating process to serve to delay recrystallization upon rolling. By delaying recrystallization, production of a ferrite core may be promoted in ferrite transformation after rolling, and thus, strength of a steel material may be improved by crystal grain refinement. In the present disclosure, a lower limit of a Nb content may be limited to 0.01% for achieving the effect. However, though the strength of a steel material is increased by addition of Nb, the increase in the strength by crystal grain refinement contributes to an increase in a yield strength rather than an increase in tensile strength. Therefore, when Nb is excessively added, the strength is increased, but the yield ratio may be increased, and thus, in the present disclosure, an upper limit of a Nb content may be limited to 0.05%. Therefore, in the present disclosure, the Nb content may be 0.01 to 0.05%.

Ca: 0.0005 to 0.005%

Ca acts as sphericalizing non-metallic inclusions such as MnS. Since Ca reacts with S to form CaS, production of the non-metallic inclusions such as MnS is suppressed, leading to improvement of low-temperature toughness. In the present disclosure, a lower limit of a Ca content may be limited to 0.0005%, for obtaining the effect of sphericalizing the non-metallic inclusions such as MnS. However, since Ca is highly volatile to have a low yield, in the present disclosure, an upper limit of a Ca content may be limited to 0.005% considering a load occurring in the manufacturing process. Therefore, in the present disclosure, the Ca content may be 0.0005 to 0.005%.

The high-strength steel material having an excellent low yield ratio characteristic according to an aspect of the present disclosure may further include, by wt %, one or two or more of: 0.05 to 0.3% of Ni, 0.05 to 0.3% of Cu, 0.005 to 0.02% of Ti, and 0.0005 to 0.0015% of B.

Ni: 0.05 to 0.3% or less

Ni is an element effective for improving both strength and toughness of steel. Therefore, in the present disclosure, a lower limit of a Ni content may be limited to 0.05%, for obtaining the effect of improving strength and toughness. However, Ni is an expensive element and excessive addition thereof is not preferred in terms of economic feasibility, and thus, in the present disclosure, an upper limit of a Ni content may be limited to 0.3%. Therefore, in the present disclosure, the Ni content may be 0.05 to 0.3%.

Cu: 0.05 to 0.3%

Cu is an element which improves strength by solid solution strengthening. Therefore, in the present disclosure, a lower limit of a Cu content may be limited to 0.05%, for obtaining the effect of improving strength. However, when Cu is excessively added, surface cracks are caused in the manufacture of a slab to deteriorate local corrosion resistance, and Cu having a low melting point penetrates a grain boundary of steel upon slab reheating for rolling to cause crack occurrence upon hot processing, and thus, in the present disclosure, an upper limit of a Cu content may be limited to 0.3%. Therefore, in the present disclosure, the Cr content may be 0.05 to 0.3%.

Ti: 0.005 to 0.02%

Ti is present as a precipitate in the form of TiN or TiC in a slab. When reheating a slab, Nb is dissolved to be solid-solubilized again, but Ti is not dissolved in a reheating process and is present in an austenite grain boundary in the form of TiN. A TiN precipitate present in the austenite grain boundary acts as suppressing austenite crystal grain growth which occurs upon reheating, and thus, contributes to final ferrite crystal grain refinement to improve strength and toughness. In the present disclosure, a lower limit of a Ti content may be limited to 0.005%, for achieving the effect of suppressing the austenite crystal grain growth. However, when an added amount of Ti is excessive, the Ti content relative to the N content in steel becomes excessive, thereby forming coarse precipitates. These coarse precipitates do not contribute to suppression of austenite crystal grain growth, but even act as a factor of lowering toughness, and thus, in the present disclosure, an upper limit of the Ti content may be limited to 0.02% considering the N content in steel.

B: 0.0005 to 0.0015% or less

B is an element having high quenchability and easily produces a low-temperature transformation phase even by addition of a small amount, and thus, is an element which effectively contributes to strength improvement and a decrease in a yield ratio. In the present disclosure, a lower limit of a B content may be limited to 0.0005%, for obtaining the effect by quenchability. However, B is an element which it is difficult to control during a steelmaking process, and when added in an appropriate amount or more, crystal grain boundary brittleness is caused to rapidly lower toughness, and thus, in the present disclosure, an upper limit of a B content may be limited to 0.0015%. Therefore, in the present disclosure, the B content may be 0.0005 to 0.0015%.

In the present disclosure, the rest other than the steel composition described above may be Fe and unavoidable impurities. The unavoidable impurities are unintentionally incorporated in a common steel manufacturing process and may not be excluded completely, and the meaning may be easily understood by a person skilled in the common steel manufacturing field. In addition, the present disclosure does not completely exclude addition of the composition other than the steel composition described above.

The high-strength steel material having an excellent low yield ratio characteristic according to an exemplary embodiment of the present disclosure may include polygonal ferrite and a residual structure as a microstructure. The polygonal ferrite may have an average particle diameter 10 μm or less, and preferably, may have an average particle size of 6 μm or less. In addition, the polygonal ferrite may have an area fraction relative to a cross section of the steel material of 10 to 30%, and an average hardness of 180 Hv or less. The residual structure includes acicular ferrite, bainite, pearlite, and martensite, and may have an average hardness of 200 Hv or more. In addition, a total fraction of pearlite and martensite in the residual structure may be 10% or less relative to a section area of the entire steel material.

The high-strength steel material having an excellent low yield ratio characteristic according to an exemplary embodiment of the present disclosure may have a Charpy impact energy at −30° C. of 200 J or more, and a tensile strength of 500 MPa or more. In addition, the high-strength steel material having an excellent low yield ratio characteristic according to an exemplary embodiment of the present disclosure may have a yield ratio of 90% or less, and more preferably 88% or less.

Hereinafter, the manufacturing method of the present disclosure will be described in detail.

The method of manufacturing a high-strength steel material having an excellent low yield ratio characteristic according to an aspect of the present disclosure may include: reheating a slab including, by wt %: 0.06 to 0.12% of C, 0.2 to 0.5% of Si, 1.5 to 2.0% of Mn, 0.003 to 0.05% of Al, 0.01% or less of N, 0.02% or less of P, 0.003% or less of S, 0.05 to 0.5% of Cr, 0.05 to 0.4% of Mo, 0.01 to 0.05% of Nb, and 0.0005 to 0.005% of Ca, with a balance of Fe and other unavoidable impurities to perform rough rolling and finish rolling; performing first cooling down to a temperature range of (Ar3−40° C.) to (Ar3−70° C.) at a first cooling rate; and performing second cooling down to a temperature range of 350 to 400° C. at a second cooling rate. In addition, the slab provided in the present disclosure may further include, by wt %, one or two or more of: 0.05 to 0.3% of Ni, 0.05 to 0.3% of Cu, 0.005 to 0.02% of Ti, and 0.0005 to 0.0015% of B.

Since a composition content of the slab of the present disclosure corresponds to the composition content of the steel material described above, description of the reason for limiting the composition content of the slab of the present disclosure is replaced with the description of the reason for limiting the composition content of the slab described above.

Slab Reheating

The slab provided with the composition described above is reheated at a temperature range of 1100 to 1160° C. In order to create a crystal grain refinement atmosphere of a final microstructure by solid-solubilized Nb, it is necessary to heat the slab to a certain temperature or higher to sufficiently decompose a NbC precipitate in the slab. Therefore, in the present disclosure, a lower limit of the slab reheating temperature may be limited to 1100° C., for achieving a crystal grain refinement effect by solid-solubilized Nb. In addition, the reheating temperature of the slab is raised, solid-solubilized Nb by NbC precipitate decomposition is easily secured, but growth of austenite crystal grains may rapidly occur to increase a crystal grain size of final ferrite. In addition, when a solid solution amount of Nb is excessive, a non-recrystallization region temperature is raised, so that crystal grain refinement may not be sufficiently performed even in the case of rolling at a high temperature, and thus, a low yield ratio characteristic may be rather deteriorated. Therefore, an upper limit of the reheating temperature of the slab of the present disclosure may be limited to 1160° C.

Rough Rolling

Rough rolling may be performed after reheating the slab. Upon rough rolling, crystal grain refinement of austenite by a recrystallization phenomenon is performed. When a rough rolling temperature is less than 1050° C., partial recrystallization occurs so that an austenite crystal grain size inside the steel material may be non-uniform. In particular, a non-uniform shape having an austenite crystal grain size in a thickness center is deepened, so that a coarse bainite microstructure is formed in the final center microstructure, and thus, low-temperature toughness is deteriorated. Therefore, in the present disclosure, a rough rolling end temperature may be limited to 1050° C. or higher.

Finish Rolling

After rough rolling, finish rolling may be performed. In order to refine an effective austenite crystal grain size in the finish rolling, it is necessary to accumulate rolling energy applied in the finish rolling by forming dislocation or forming a deformation band of austenite crystal grains, and for this, a start temperature of the finish rolling should be limited. When the start temperature of the finish rolling is higher than 980° C., most of the effect of rolling energy accumulation of the finish rolling by annealing is lost, and thus, the crystal grains of effective austenite may not be sufficiently refined, and the refinement effect of ferrite crystal grains may not be sufficiently achieved. Therefore, for securing a desired microstructure, in the present disclosure, the start temperature of the finish rolling may be limited to 980° C. or higher.

In addition, the deformation of austenite crystal grains may be formed when the finish rolling temperature is lower than a recrystallization region temperature (Tnr). That is, a reduction ratio applied at a temperature lower than the recrystallization region temperature (Tnr), that is, an effective reduction ratio is an important element which more influences strength and toughness improvement, rather than a reduction ratio applied throughout the finish rolling. When the effective reduction ratio is not sufficient during the finish rolling, fine crystal grains may not be produced in ferrite transformation, and also the crystal grains of effective austenite are coarse so that the bainite fraction by quenchability is excessively increased, and thus, toughness and a yield ratio may be deteriorated. Therefore, the effective reduction ratio of the finish rolling may be 65% or more in the present disclosure. For reference, the effective reduction ratio and the recrystallization region temperature (Tnr) may be theoretically derived by Equations 1 and 2, and the recrystallization region temperature (Tnr) of the present disclosure may refer to a temperature at which recrystallization of austenite stops.

Effective reduction ratio (%)=[(Thickness of steel material directly under Tnr temperature−Final thickness of steel material,mm)/Thickness of steel material directly under Tnr temperature, mm]*100 [Equation 1]

$$Tnr(^\circ C.)=887+464*C+890*Ti+363*Al-357*Si+(6445*Nb-644*Nb^{1/2})+(732*V-230*V^{1/2})$$

Upon the finish rolling, the rolling energy applied is accumulated by forming dislocation or a deformation band in austenite crystal grains. As the finish rolling temperature is lowered, production of the deformation band is promoted to increase ferrite core production sites, thereby refining final crystal grains. In addition, as the finish rolling temperature is raised, dislocation extinction and the like easily occur, and thus, rolling energy may easily disappear without accumulation. Therefore, considering the components limited in the present disclosure, the effective reduction ratio of the finish rolling, and the like, the finish rolling should be ended at least 900° C. or lower for securing low-temperature toughness. When the steel material is moved for cooling after the finish rolling, temperature drop of the steel material occurs by air cooling. In order to prevent a cooling start temperature from falling to Ar3+10° C. or lower by air cooling before cooling starts, the end temperature of the finish rolling may be limited to (Ar3+50° C.) or higher. Therefore, the end temperature of the finish rolling of the present disclosure may be (Ar3+50° C.) to 900° C. For reference, the temperature Ar3 may be theoretically derived by the following Equation 3:

$$Ar3(^\circ C.)=910-310*C-80*Mn-20*Cu-15*Cr-55*Ni-80*Mo+0.35*(\text{Steel material thickness}-8,mm)$$

First Cooling

Transformation from austenite to ferrite is controlled by cooling after finish rolling, thereby determining the final microstructure of a steel material. In order to secure a desired yield ratio, phases having different hardnesses should be present in combination at an appropriate ratio, and in particular, a ferrite fraction and a hardness of a high-hardness phase should satisfy appropriate ranges. In order to appropriately introduce fine polygonal ferrite by the first cooling after the finish rolling, the first cooling should start at a somewhat higher temperature than Ar3, and when the first cooling starts at a higher temperature than Ar3 by about 10 to 30° C., fine polygonal ferrite having the most appropriate ratio may be introduced. Therefore, a start temperature of the first cooling may be (Ar3+10° C.) to (Ar3+30° C.)

In order to secure a low yield ratio characteristic of the steel material, a microstructure in which fine ferrite and low temperature transformation phases are mixed should be obtained. However, when a fine ferrite fraction is excessive, a low yield ratio characteristic may be secured, but a yield strength is lowered, so that a high-strength characteristic may not be secured. When an end temperature of the first cooling is lower than Ar3−70° C., the ferrite fraction is excessively increased so that it is difficult to secure a high-strength characteristic, and when the end temperature of the first cooling is higher than Ar3−40° C., the ferrite fraction is lowered so that it is difficult to secure a low yield ratio characteristic. Therefore, in the present disclosure, the cooling end temperature of the first cooling may be limited to (Ar3−70° C.) to (Ar3−40° C.)

The first cooling rate should be controlled to be not excessively fast so that polygonal ferrite is produced without initiating bainite transformation in the first cooling. Therefore, the first cooling rate may be limited to 10 to 20° C./s. When the first cooling rate is less than 10° C./s, water-cooled ferrite is relatively coarsely produced to lower a yield strength, and when the first cooling rate is more than 20° C./s, polygonal ferrite is underproduced and the fractions of low temperature transformation phases are greatly increased, thereby securing a low yield ratio characteristic. Therefore, the first cooling rate of the present disclosure may be limited to 10 to 20° C./s.

Second Cooling

An end temperature of second cooling should be sufficiently lower than a bainite transformation end temperature, so that austenite which is not transformed in the first cooling may be sufficiently transformed into a low-temperature transformation phase such as bainite. Therefore, in the present disclosure, a second cooling end temperature may be limited to 400° C. or lower. However, when the second cooling end temperature is excessively low, the production amount of highly brittle martensite is increased, and thus, a yield ratio may be lowered, but toughness may be decreased. Therefore, for inhibiting production of martensite, the second cooling end temperature of the present disclosure may be limited to 350° C. or higher. Therefore, the second cooling end temperature of the present disclosure may be 350 to 400° C. After ending the second cooling, cooling may be performed down to room temperature by air cooling.

The second cooling rate may be controlled to be higher than the first cooling rate, so that austenites which have not been transformed into ferrites in the first cooling are all transformed into bainites. The second cooling rate may be higher than the first cooling rate by 10 to 40° C./s, and the preferred second cooling rate of the present disclosure may be 30 to 50° C./s.

In addition, in terms of a microstructure, it is preferred that the second cooling is performed directly after the first cooling.

MODE FOR INVENTION

Hereinafter, the present disclosure will be described in detail through the specific examples.

EXAMPLES

Steel slabs satisfying the component system described in the following Table 1 were manufactured, and steel materials for each slab were manufactured under the process conditions of Table 2.

TABLE 1

| Steel type | C | Si | Mn | P | S | Al | Cr | Mo | Nb | N | Ca | Ni | Cu | Ti | B |
|---|---|---|---|---|---|---|---|---|---|---|---|---|---|---|---|
| 1 | 0.06 | 0.3 | 1.6 | 0.015 | 0.0017 | 0.015 | 0.15 | 0.4 | 0.03 | 0.0045 | 0.0012 | 0.3 | | | |
| 2 | 0.06 | 0.3 | 1.9 | 0.018 | 0.0015 | 0.003 | 0.3 | 0.1 | 0.04 | 0.004 | 0.001 | 0.2 | 0.1 | | |
| 3 | 0.06 | 0.5 | 1.6 | 0.016 | 0.0009 | 0.02 | 0.4 | 0.1 | 0.035 | 0.005 | 0.0015 | 0.1 | | 0.012 | |
| 4 | 0.07 | 0.3 | 1.5 | 0.01 | 0.0011 | 0.015 | 0.2 | 0.2 | 0.04 | 0.004 | 0.001 | | | 0.015 | 0.001 |
| 5 | 0.07 | 0.3 | 1.6 | 0.015 | 0.001 | 0.02 | 0.1 | 0.3 | 0.02 | 0.004 | 0.0008 | 0.2 | | | |
| 6 | 0.07 | 0.4 | 1.8 | 0.012 | 0.0015 | 0.02 | 0.3 | 0.2 | 0.03 | 0.005 | 0.0013 | 0.1 | 0.1 | 0.015 | |
| 7 | 0.08 | 0.3 | 1.5 | 0.009 | 0.0023 | 0.035 | 0.2 | 0.1 | 0.015 | 0.0055 | 0.0012 | | | | 0.001 |
| 8 | 0.08 | 0.5 | 1.6 | 0.012 | 0.0024 | 0.03 | 0.2 | 0.2 | 0.025 | 0.0035 | 0.002 | | 0.1 | 0.015 | |
| 9 | 0.09 | 0.2 | 1.5 | 0.015 | 0.0018 | 0.035 | 0.1 | 0.05 | 0.025 | 0.004 | 0.0018 | 0.1 | | | |
| 10 | 0.04 | 0.25 | 1.4 | 0.008 | 0.0008 | 0.03 | 0.1 | | 0.055 | 0.005 | 0.0019 | 0.1 | | 0.012 | |
| 11 | 0.06 | 0.25 | 1.25 | 0.015 | 0.002 | 0.025 | 0.3 | 0.2 | | 0.004 | 0.001 | | 0.2 | | |

TABLE 1-continued

| Steel type | C | Si | Mn | P | S | Al | Cr | Mo | Nb | N | Ca | Ni | Cu | Ti | B |
|---|---|---|---|---|---|---|---|---|---|---|---|---|---|---|---|
| 12 | 0.06 | 0.3 | 1.5 | 0.025 | 0.0015 | 0.055 | 0.2 | 0.3 | 0.02 | 0.005 | | | | | |
| 13 | 0.08 | 0.15 | 1.6 | 0.018 | 0.0014 | 0.035 | | 0.1 | | 0.004 | 0.0012 | | | | |
| 14 | 0.08 | 0.3 | 1.3 | 0.023 | 0.0031 | 0.03 | 0.1 | 0.1 | 0.03 | 0.005 | | | | | |
| 15 | 0.12 | 0.25 | 1.1 | 0.015 | 0.002 | 0.025 | | | 0.03 | 0.004 | 0.0013 | | | 0.01 | |

TABLE 2

| Steel type | Conditions | Reheating temperature (° C.) | Rough rolling end temperature (° C.) | Finish rolling effective reduction ratio (%) | Finish rolling start temperature (° C.) | Finish rolling end temperature (° C.) | First cooling start temperature (° C.) |
|---|---|---|---|---|---|---|---|
| 1 | 1-1 | 1140 | 1080 | 65 | 880 | 830 | 730 |
| | 1-2 | 1140 | 1080 | 65 | 910 | 850 | 740 |
| | 1-3 | 1120 | 1050 | 75 | 880 | 830 | 780 |
| 2 | 2-1 | 1120 | 1050 | 70 | 910 | 820 | 740 |
| | 2-2 | 1120 | 1060 | 70 | 930 | 820 | 730 |
| | 2-3 | 1140 | 1080 | 55 | 830 | 790 | 740 |
| 3 | 3-1 | 1150 | 1100 | 65 | 900 | 830 | 770 |
| | 3-2 | 1150 | 1090 | 65 | 880 | 800 | 760 |
| | 3-3 | 1140 | 1080 | 70 | 850 | 810 | 775 |
| 4 | 4-1 | 1160 | 1100 | 75 | 950 | 880 | 770 |
| | 4-2 | 1140 | 1080 | 75 | 980 | 880 | 780 |
| | 4-3 | 1080 | 1000 | 78 | 850 | 770 | 710 |
| 5 | 5-1 | 1120 | 1060 | 65 | 850 | 800 | 750 |
| | 5-2 | 1140 | 1080 | 65 | 880 | 820 | 740 |
| 6 | 6-1 | 1100 | 1050 | 70 | 900 | 830 | 750 |
| | 6-2 | 1120 | 1060 | 70 | 880 | 810 | 740 |
| 7 | 7 | 1140 | 1070 | 65 | 880 | 830 | 780 |
| 8 | 8 | 1150 | 1090 | 65 | 850 | 800 | 770 |
| 9 | 9 | 1120 | 1060 | 70 | 930 | 850 | 780 |
| 10 | 10-1 | 1160 | 1080 | 80 | 1000 | 880 | 780 |
| | 10-2 | 1180 | 1120 | 75 | 900 | 810 | 750 |
| 11 | 11-1 | 1120 | 1080 | 60 | 800 | 760 | 730 |
| | 11-2 | 1180 | 1120 | 60 | 840 | 790 | 730 |
| 12 | 12-1 | 1080 | 1040 | 65 | 880 | 810 | 760 |
| | 12-2 | 1100 | 1040 | 60 | 850 | 780 | 770 |
| 13 | 13-1 | 1140 | 1080 | 65 | 880 | 810 | 780 |
| | 13-2 | 1160 | 1100 | 70 | 880 | 790 | 740 |
| 14 | 14 | 1120 | 1060 | 70 | 910 | 820 | 780 |
| 15 | 15 | 1140 | 1070 | 70 | 950 | 860 | 810 |

| Steel type | First cooling end temperature (° C.) | First cooling rate (° C./s) | Second cooling end temperature (° C.) | Second cooling end rate (° C./s) | Tnr temperature (° C.) | Ar3 temperature (° C.) |
|---|---|---|---|---|---|---|
| 1 | 650 | 10 | 400 | 30 | 894.99 | 718.6 |
| | 650 | 15 | 380 | 32 | 894.99 | 718.6 |
| | — | — | 560 | 28 | 894.99 | 718.6 |
| 2 | 660 | 10 | 400 | 30 | 937.83 | 719.85 |
| | 660 | 15 | 350 | 35 | 937.83 | 719.85 |
| | 550 | 8 | 400 | 15 | 937.83 | 719.85 |
| 3 | 690 | 18 | 400 | 35 | 859.37 | 749.85 |
| | 700 | 12 | 380 | 42 | 859.37 | 749.85 |
| | 685 | 16 | 380 | 40 | 859.37 | 749.85 |
| 4 | 700 | 15 | 400 | 40 | 960.18 | 755.25 |
| | 690 | 17 | 350 | 45 | 960.18 | 755.25 |
| | 630 | 8 | 400 | 20 | 960.18 | 755.25 |
| 5 | 675 | 15 | 380 | 42 | 857.46 | 729.75 |
| | 660 | 13 | 350 | 35 | 857.46 | 729.75 |
| 6 | 660 | 12 | 380 | 32 | 879.10 | 722.25 |
| | 680 | 13 | 400 | 32 | 879.10 | 722.25 |
| 7 | 700 | 18 | 380 | 35 | 847.53 | 760.15 |
| 8 | 675 | 10 | 350 | 40 | 829.16 | 742.15 |
| 9 | 700 | 16 | 400 | 45 | 929.36 | 757.05 |
| 10 | 680 | 20 | 480 | 30 | 1041.32 | 784.55 |
| | 700 | 10 | 500 | 25 | 1041.32 | 784.55 |
| 11 | 680 | 15 | 400 | 30 | 834.67 | 772.85 |
| | 700 | 8 | 400 | 32 | 834.67 | 772.85 |
| 12 | 700 | 12 | 430 | 28 | 865.53 | 750.35 |
| | 650 | 18 | 450 | 35 | 865.53 | 750.35 |
| 13 | 730 | 10 | 500 | 30 | 883.28 | 755.15 |
| | 600 | 21 | 480 | 25 | 883.28 | 755.15 |

TABLE 2-continued

| | | | | | | |
|---|---|---|---|---|---|---|
| 14 | 730 | 12 | 500 | 30 | 909.72 | 777.65 |
| 15 | 650 | 25 | 450 | 25 | 953.21 | 790.75 |

A tensile test was performed for a tensile specimen obtained by cutting each steel material manufactured by Table 2 along a length direction to evaluate a yield strength, a tensile strength, and a Charpy impact energy at −30° C., and the results are shown in the following Table 3. In addition, for each steel material manufactured by Table 2, the microstructure after etching was observed, the hardness of each structure was measured, and the fraction and the hardness of polygonal ferrite of each steel material and the fraction and the hardness of the phases (pearlite+martensite) other than polygonal ferrite are as shown in the following Table 4.

TABLE 3

| Steel type | Conditions | Yield strength (MPa) | Tensile strength (MPa) | Yield ratio (%) | Charpy impact Energy at −30° C. (J) | Remarks |
|---|---|---|---|---|---|---|
| 1 | 1-1 | 485 | 557 | 87 | 420 | Inventive Example 1 |
| | 1-2 | 501 | 583 | 86 | 415 | Inventive Example 2 |
| | 1-3 | 547 | 589 | 92 | 187 | Comparative Example 1 |
| 2 | 2-1 | 473 | 544 | 87 | 397 | Inventive Example 3 |
| | 2-2 | 496 | 598 | 83 | 389 | Inventive Example 4 |
| | 2-3 | 442 | 480 | 92 | 167 | Comparative Example 2 |
| 3 | 3-1 | 492 | 579 | 85 | 371 | Inventive Example 5 |
| | 3-2 | 503 | 599 | 84 | 375 | Inventive Example 6 |
| | 3-3 | 510 | 593 | 86 | 370 | Inventive Example 7 |
| 4 | 4-1 | 504 | 600 | 84 | 358 | Inventive Example 8 |
| | 4-2 | 498 | 600 | 83 | 361 | Inventive Example 9 |
| | 4-3 | 467 | 513 | 91 | 185 | Comparative Example 3 |
| 5 | 5-1 | 524 | 616 | 85 | 387 | Inventive Example 10 |
| | 5-2 | 535 | 652 | 82 | 364 | Inventive Example 11 |
| 6 | 6-1 | 541 | 644 | 84 | 340 | Inventive Example 12 |
| | 6-2 | 545 | 626 | 87 | 349 | Inventive Example 13 |
| 7 | 7 | 527 | 635 | 83 | 308 | Inventive Example 14 |
| 8 | 8 | 552 | 681 | 81 | 311 | Inventive Example 15 |
| 9 | 9 | 524 | 639 | 82 | 287 | Inventive Example 16 |
| 10 | 10-1 | 475 | 528 | 90 | 198 | Comparative Example 4 |
| | 10-2 | 458 | 503 | 91 | 172 | Comparative Example 5 |
| 11 | 11-1 | 486 | 540 | 90 | 187 | Comparative Example 6 |
| | 11-2 | 492 | 547 | 90 | 113 | Comparative Example 7 |
| 12 | 12-1 | 502 | 558 | 90 | 175 | Comparative Example 8 |
| | 12-2 | 483 | 531 | 91 | 175 | Comparative Example 9 |
| 13 | 13-1 | 511 | 568 | 90 | 198 | Comparative Example 10 |
| | 13-2 | 472 | 519 | 91 | 142 | Comparative Example 11 |
| 14 | 14 | 535 | 582 | 92 | 167 | Comparative Example 12 |
| 15 | 15 | 508 | 558 | 91 | 118 | Comparative Example 13 |

TABLE 4

| Steel Type | Conditions | Polygonal ferrite fraction (%) | Average hardness of polygonal ferrite (Hv) | Average hardness of phases other than polygonal ferrite (Hv) | Pearlite + martensite fraction (%) | Remarks |
|---|---|---|---|---|---|---|
| 1 | 1-1 | 27 | 167 | 234 | 7 | Inventive Example 1 |
| | 1-2 | 30 | 170 | 239 | 6 | Inventive Example 2 |
| | 1-3 | 7 | 165 | 210 | 12 | Comparative Example 1 |
| 2 | 2-1 | 27 | 15 | 229 | 6 | Inventive Example 3 |
| | 2-2 | 25 | 177 | 237 | 7 | Inventive Example 4 |
| | 2-3 | 72 | 179 | 207 | 22 | Comparative Example 2 |
| 3 | 3-1 | 27 | 177 | 235 | 6 | Inventive Example 5 |
| | 3-2 | 25 | 174 | 247 | 8 | Inventive Example 6 |
| | 3-3 | 27 | 174 | 241 | 6 | Inventive Example 7 |
| 4 | 4-1 | 24 | 173 | 237 | 7 | Inventive Example 8 |
| | 4-2 | 25 | 177 | 249 | 8 | Inventive Example 9 |
| | 4-3 | 64 | 168 | 223 | 19 | Comparative Example 3 |
| 5 | 5-1 | 27 | 170 | 239 | 6 | Inventive Example 10 |
| | 5-2 | 24 | 172 | 247 | 8 | Inventive Example 11 |
| 6 | 6-1 | 29 | 168 | 241 | 7 | Inventive Example 12 |
| | 6-2 | 28 | 172 | 240 | 8 | Inventive Example 13 |
| 7 | 7 | 18 | 178 | 253 | 9 | Inventive Example 14 |
| 8 | 8 | 30 | 166 | 254 | 9 | Inventive Example 15 |
| 9 | 9 | 24 | 173 | 251 | 8 | Inventive Example 16 |
| 10 | 10-1 | 8 | 181 | 220 | 12 | Comparative Example 4 |
| | 10-2 | 6 | 188 | 209 | 11 | Comparative Example 5 |
| 11 | 11-1 | 40 | 172 | 208 | 12 | Comparative Example 6 |
| | 11-2 | 33 | 164 | 248 | 11 | Comparative Example 7 |
| 12 | 12-1 | 6 | 182 | 220 | 11 | Comparative Example 8 |
| | 12-2 | 7 | 188 | 207 | 11 | Comparative Example 9 |
| 13 | 13-1 | 36 | 164 | 205 | 12 | Comparative Example 10 |
| | 13-2 | 7 | 189 | 238 | 13 | Comparative Example 11 |
| 14 | 14 | 40 | 172 | 199 | 15 | Comparative Example 12 |
| 15 | 15 | 2 | 191 | 268 | 14 | Comparative Example 13 |

Since Inventive Examples 1 to 16 satisfied all of the steel composition, the microstructure, and the process condition of the present disclosure, it was confirmed that a Charpy impact energy at −30° C. of 200 J or more, a tensile strength of 500 MPa or more, and a yield ratio of 90% or less were all satisfied. In particular, it was confirmed that Inventive Examples 1 to 16 all had a yield ratio of less than 90%.

Comparative Example 1 satisfied the composition content of the present disclosure, but since cooling was performed only once without dividing into the first cooling and the second cooling and the first cooling start temperature was out of the range of the present disclosure, it was confirmed that the microstructure conditions of the present disclosure were not satisfied. Therefore, it was confirmed that the desired low-temperature toughness of the present disclosure was not secured in Comparative Example 1.

Comparative Example 2 satisfied the composition content of the present disclosure, but since the finish rolling effective reduction ratio and the first cooling rate did not satisfy the range of the present disclosure, it was confirmed that the microstructure of the present disclosure was not satisfied. Therefore, it was confirmed that the desired tensile strength and low-temperature toughness of the present disclosure were not secured.

Comparative Example 3 satisfied the composition content of the present disclosure, but since the reheating temperature, the rough rolling end temperature, the finish rolling end temperature, and the first cooling start and end temperature did not satisfy the range of the present disclosure, it was confirmed that the microstructure conditions of the present disclosure were not satisfied. Therefore, it was confirmed that the desired low-temperature toughness of the present disclosure was not secured in Comparative Example 3.

In addition, in Comparative Examples 4 to 13, the steel composition, the microstructure, and the process conditions of the present disclosure were all not satisfied, and thus, it was confirmed that the desired physical properties of the present disclosure were not secured.

Accordingly, a high-strength steel material having an excellent low yield ratio characteristic and a method of manufacturing the same according to an exemplary embodiment of the present disclosure satisfy all of a low yield ratio characteristic and a high strength property, thereby providing a pipe steel material allowing stability and pipe making ability to be secured and a method of manufacturing the same.

Hereinabove, the present disclosure has been described in detail by the exemplary embodiments, but other exemplary embodiments having different forms are possible. Therefore, the technical spirit and scope of the claims set forth below are not limited by the exemplary embodiments.

The invention claimed is:

1. A steel material comprising, by wt %:

0.06 to 0.12% of C, 0.2 to 0.5% of Si, 1.5 to 2.0% of Mn, 0.003 to 0.05% of Al, 0.01% or less of N, 0.02% or less of P, 0.003% of less of S, 0.05 to 0.5% of Cr, 0.05 to 0.5% of Mo, 0.01 to 0.05% of Nb, and 0.0005 to 0.005% of Ca, with a balance of Fe and other unavoidable impurities, and wherein the polygonal ferrite has an area fraction of 10 to 30% and an average hardness of 180 Hv or less, wherein the residual structure comprises acicular ferrite, bainite, pearlite, and martensite, wherein the residual structure as an average hardness of 200 Hv or more, wherein a sum of area fractions of the pearlite and the martensite is 10% or less, excluding 0%, relative to a total area.

2. The steel material of claim 1, further comprising, by wt %, one or two or more of: 0.05 to 0.3% of Ni, 0.05 to 0.3% of Cu, 0.005 to 0.02% of Ti, and 0.0005 to 0.0015% of B.

3. The steel material of claim 1, wherein the steel material has a Charpy impact energy at −30° C. of 200 J or more.

4. The steel material of claim 1, wherein the steel material has a yield ratio of 90% or less.

5. The steel material of claim 1, wherein the steel material has a tensile strength of 500 MPa or more.

* * * * *